US006140972A

United States Patent [19]

Johnston et al.

[11] Patent Number: 6,140,972

[45] Date of Patent: Oct. 31, 2000

[54] MULTIPORT ANTENNA

[75] Inventors: Ronald H. Johnston; Edwin Tung, both of Calgary, Canada

[73] Assignee: Telecommunications Research Laboratories, Edmonton, Canada

[21] Appl. No.: 09/221,559

[22] Filed: Dec. 28, 1998

[30] Foreign Application Priority Data

Dec. 11, 1998 [CA] Canada ..... 2-255516

[51] Int. Cl.[7] ..... H01Q 21/00

[52] U.S. Cl. ..... 343/725; 343/853; 343/893

[58] Field of Search ..... 343/725, 726, 343/728, 729, 853, 835, 836, 837, 893; H01Q 21/00

[56] References Cited

U.S. PATENT DOCUMENTS

| | | | |
|---|---|---|---|
| 2,897,496 | 7/1959 | Woodward | 343/818 |
| 4,101,901 | 7/1978 | Kommrusch | 343/853 |
| 4,170,759 | 10/1979 | Stimple et al. | 325/51 |
| 4,213,132 | 7/1980 | Davidson | 343/854 |
| 4,446,465 | 5/1984 | Donovan | 343/797 |
| 4,983,988 | 1/1991 | Franke | 343/853 |
| 5,185,611 | 2/1993 | Bitter, Jr. | 343/702 |
| 5,654,724 | 8/1997 | Chu | 343/742 |

OTHER PUBLICATIONS

The Corner–Reflector Antenna, John D. Kraus, Proceedings of the I.R.E., Nov., 1940, p. 513–519.

Corner Reflector Antennas with Arbitrary Dipole Orientation and Apex Angle, Ralph W. Klopfenstein, I.R.E. Transactions on Antennas and Propagation, Jul., 1957, p. 297–305.

Three Dimensional Corner Reflector Antenna, Naoki Inagaki, IEEE Transactions on Antennas and Propagation, Jul., 1974, p. 580–582.

Cylindrical and Three–Dimensional Corner Reflector Antennas, Hassan M. Elkamchouchi, IEEE Transactions on Antennas and Propagation, vol. AP–31, No. 3, May., 1983, p. 451–455.

References sheet, Lucent Technologies, Sep. 10, 1998 1 page.

*Primary Examiner*—Hoanganh Le

*Attorney, Agent, or Firm*—Flynn, Thiel, Boutell & Tanis, P.C.

[57] ABSTRACT

A multiport beamforming antenna provides multidirectional beam patterns with minimum interference comprising multiple, as for example twelve, radiating elements mounted on a conducting ground plane. Multiple, for example six, reflecting surfaces, each having a shape of one quarter of a circle or an ellipse, are radially disposed about the center of a round ground plane conductor to give a hemispherical shape with multiple, for example six, equal sectors. Each sector of the multiport antenna contains two types of radiating elements mounted adjacent to the corner of the reflector. The first elemental antenna is responsive to energy having a first polarization, while the second elemental antenna is responsive to energy having a polarization orthogonal to the first polarization. With such an arrangement, all the radiating elements are located in close proximity without coupling signals to each other, and each element is capable of producing a directional radiation pattern in an independent manner. Consequently, the physical area required to install the antenna is minimized, and the antenna provides very good hemispherical coverage and for example may be placed anywhere on the ceiling of a room to provide coverage of the entire room.

27 Claims, 11 Drawing Sheets

ALL DIMENSIONS SHOWN ARE IN WAVELENGTHS

ALL DIMENSIONS ARE IN WAVELENGTHS

MULTIPORT ANTENNA

FIELD OF THE INVENTION

The present invention relates generally to radio frequency antennas and, in particular, to a multiport antenna that produces multidirectional beams with high isolation between ports.

BACKGROUND OF THE INVENTION

Increased channel capacity is a very desirable goal as indicated by the cellular and personal communication service providers. With available spectrum limiting channel capacity, cellular service providers quickly reach maximum usage in a given system. Since the conventional cellular systems limit the number of users on the same channel at a time, it is very desirable to design an antenna system that can handle multiple users on the same frequency at the same time, and thus, increase the capacity of each channel. Co-channel interference is another serious technical problem in cellular radio. Co-channel interference, which is caused by interference from other users operating at the same frequency as the designated user, is increased in a multipath environment. Due to the presence of co-channel interference, the quality of the received signals is degraded substantially. There is therefore a need to improve cancellation of co-channel interference.

There are known antennas, referred to as corner reflector antennas, which employ a radiating element mounted adjacent to the corner of a pair of intersecting reflecting surfaces provides a directional radiation pattern in azimuth. In some applications, a number of corner reflector antennas have been put together to enhance the antenna gain of the overall system. A corner reflector [such as described in The Corner-Reflector Antenna, John D. Kraus, Proceedings of the I.R.E., November 1940, p. 513–519] uses a dipole located parallel with two planes that intersect each other with an angle of 90°. One can use any angle that is 360°/n, where n is an even integer. One can make n=2 and a plane reflector results, or n=4 where θ=90° (the usual case), and a right angle corner reflector results, or n=6 where θ=60° (somewhat higher gain than the usual case if the two reflecting sheets are large enough). Normally, n values of 8 or larger do not produce a practical antenna with respect to size, gain and input impedance. Woodward [U.S. Pat. No. 2,897,496 issued July 1959] has shown how one can put various driven elements into the antenna, such as center-fed conductors attached to the two conducting sheets, tilted dipoles and square cross-sectional helices. Inagaki [Three-Dimensional Corner Reflector Antenna, Naoki Inagaki, IEEE Transactions on Antennas and Propagation, July, 1974, p. 580–582] and Elkamchouchi [Cylindrical and Three-Dimensional Corner Reflector Antennas, Hassan M. Elkamchouchi, IEEE Transactions on Antennas and Propagation, vol. AP-31, No. 3, May, 1983, p. 45–455] treat the case of adding a third plane to the antenna to obtain a three-dimensional corner reflector antenna. Klopfenstein [Corner Reflector Antennas with Arbitrary Dipole Orientation and Apex Angle, Ralph W. Klopfenstein, I.R.E. Transactions on Antennas and Propagation, July, 1957, p. 297–305] has also considered the corner reflector with arbitrary angles as well as an arbitrary dipole orientation.

Kommrusch [U.S. Pat. No. 4,101,901 issued July 1978], Davidson [U.S. Pat. No. 4,213,132 issued July 1980] and Stimple [U.S. Pat. No. 4,170,759 issued October 1979] use multiple corner reflector antennas for interleaved beams, multiple frequency inputs, and a switched antenna arrangement respectively. In these devices, a fixed splitting and coupling arrangement connects the transmitters or receivers to the multiple antennas. Franke [U.S. Pat. No. 4,983,988 issued January. 1991] also uses a multiple (4 element) corner reflector for a cellular radio application. All of these multiple corner reflector antennas have good isolation between antennas. Another type of sectored antenna is described by Bitter [U.S. Pat. No. 5,185,611 issued February 1993]. Three antennas are built into a single structure and the design provides good isolation between the elemental antennas. Yet another type of multiple antenna is described by Chu [U.S. Pat. No. 5,654,724 issued August 1997]. This arrangement uses four half loops mounted over a ground plane. These loops are connected to splitters in a fixed arrangement to the transmitter and receiver. The inter-element isolation in this antenna is achieved primarily by the spatial separation of the loops.

SUMMARY OF THE INVENTION

It is therefore an object of this invention to provide a multiport antenna that reduces co-channel interference and increases the capacity of each sector of the multiport antenna.

It is a further object of the invention to take advantage of the multipath environment, and provide an antenna structure that produces multidirectional beam patterns with maximal port to port isolation.

With elemental antennas isolated from each other, a multiport antenna may transmit or receive multiple signals having independent fading characteristics. Accordingly, by utilizing an antenna of this type, multipath signals can be received and combined to allow recovery of the original multiple signals transmitted from different spatial locations.

It is a further object of the present invention to provide a multiport antenna that radiates or receives multidirectional electromagnetic waves with different planes of polarization. This enhances coupling between the signals and the antenna elements, since multipath signals may arrive from all directions at the base station and they may be repolarized after reflections. Preferably, polarization diversity is applied to isolated sectors of the antenna structure. Consequently, two radiating elements with orthogonal polarizations can be located closely together in each sector without coupling to each other and therefore maintain a high isolation.

In order to sustain a good isolation between radiating elements, according to an aspect of the invention, there is provided a multiport antenna that uses multiple corner reflectors to divide an antenna structure into a number of sectors. The corner reflectors provide a shield for elements in one sector from being affected by elements in other sectors while maintaining a compact antenna structure. With the utilization of these reflectors, a multiport antenna is capable of providing multidirectional radiation patterns in an independent manner, and whereby, pattern diversity is obtained.

By applying the two diversity techniques to the same antenna, a multiport antenna overcomes one of the main problems of the conventional beamforming antenna, which is usually a linear or two-dimensional array of radiating elements with a separation of very roughly a half wavelength between elements. The proposed structure allows the elemental antennas to be in close proximity while maintaining low mutual coupling.

In accordance with an aspect of the invention, a multiport beamforming antenna provides multidirectional beam patterns with minimum interference comprising multiple, as for example twelve, radiating elements mounted on a conducting ground plane. Multiple, for example six, reflecting surfaces, each having a shape of one quarter of a circle or an ellipse or a portion of a polygon, such as a square, rectangle or triangle, are radially disposed about the center of a round ground plane conductor to give a hemispherical shape with multiple, for example six, equal sectors.

According to an aspect of the invention, each sector of the multiport antenna contains two types of radiating elements mounted adjacent to the corner of the reflector. The first elemental antenna is responsive to energy having a first polarization, while the second elemental antenna is responsive to energy having a polarization orthogonal to the first polarization. With such an arrangement, all the radiating elements are located in close proximity without coupling signals to each other, and each element is capable of producing a directional radiation pattern in an independent manner. Consequently, the physical area required to install the antenna is minimized. The antenna has good hemispherical coverage and for example the antenna may be placed anywhere on the ceiling of a room to provide coverage of the entire room.

In a preferred embodiment of the present invention, the first elemental antenna comprises a horizontal center-fed loop antenna mounted closely to the angle of intersection, on the corner reflector, and coupled to a first feed on the ground plane conductor through a transmission line. The second elemental antenna comprises a vertical monopole mounted a distance from the loop antenna on the ground plane conductor, and coupled to a second feed on the ground plane. The horizontal loop antenna produces a horizontally polarized beam with a directional radiation pattern aiming at a direction determined by the corner reflector, while the vertical monopole antenna produces a vertically polarized beam with a directional radiation pattern aiming at the same direction as the loop antenna in the same sector. It has been found that, with such an arrangement, the elements are substantially isolated from each other and the input impedance of each element can be easily and independently matched.

Thus, according to an aspect of the invention, there is provided a multiport antenna having an operating frequency with wavelength $\lambda$, the multiport antenna comprising:

multiple corner reflectors, each corner reflector being mounted to produce a radiation pattern that extends outward from the multiport antenna;

plural first elemental antennas, a first elemental antenna being disposed in each corner reflector, each first elemental antenna being oriented to produce a first radiation pattern having a first polarization; and plural second elemental antennas, a second elemental antenna being disposed in each corner reflector, each second elemental antenna being oriented to produce a second radiation pattern having a second polarization that is different from the first polarization.

Further aspects of the invention may be found in the detailed description that follows and the claims.

BRIEF DESCRIPTION OF THE DRAWINGS

There will now be described preferred embodiments of the invention, by way of example only, without intending to limit the scope of the claims to the precise embodiments disclosed, in which figures like reference characters denote like elements, and in which:

DETAILED DESCRIPTION OF THE DRAWINGS

Figure 1:
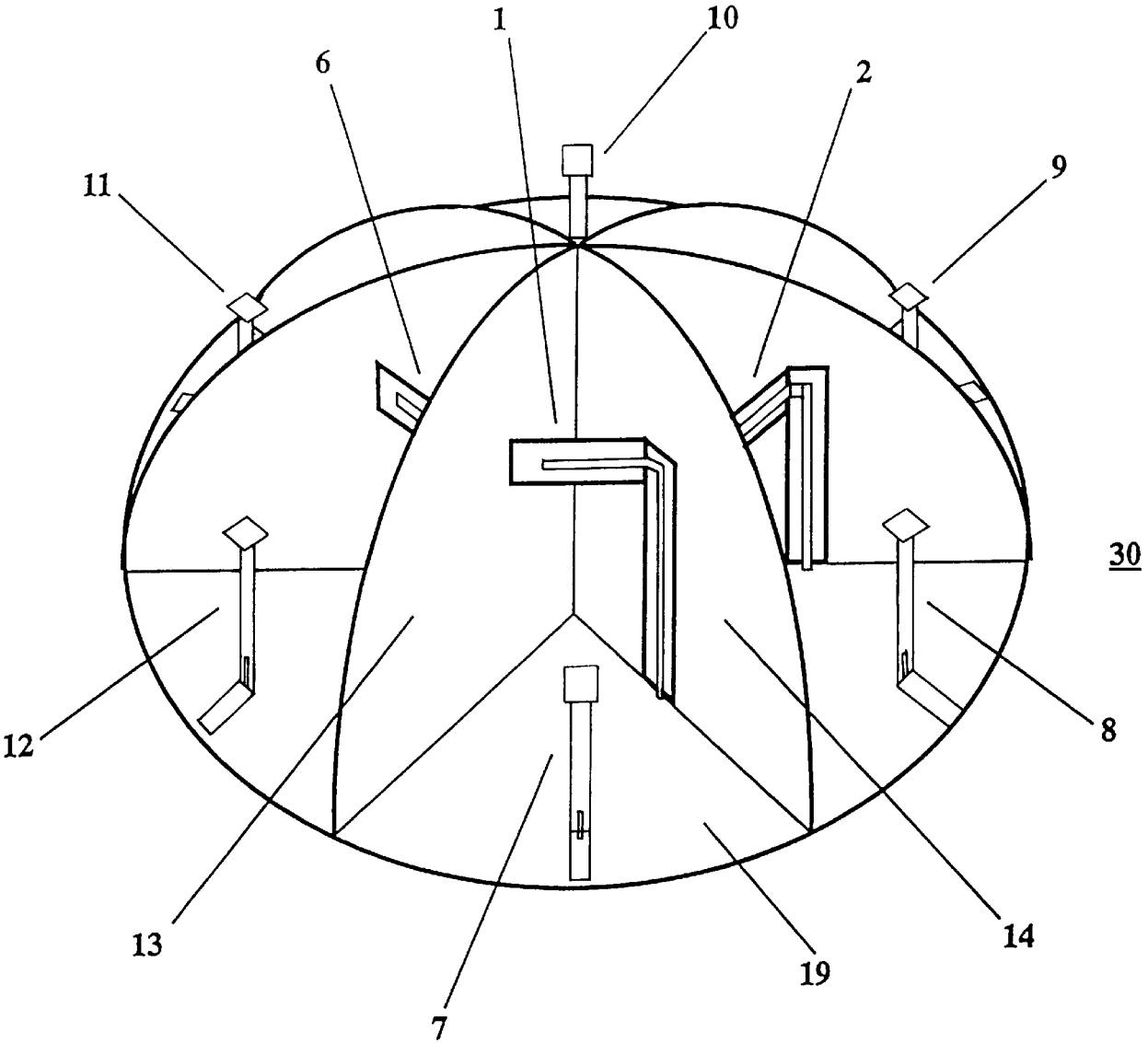
FIG. 1 is an isometric view of a preferred embodiment of the present invention.
Figure 2:
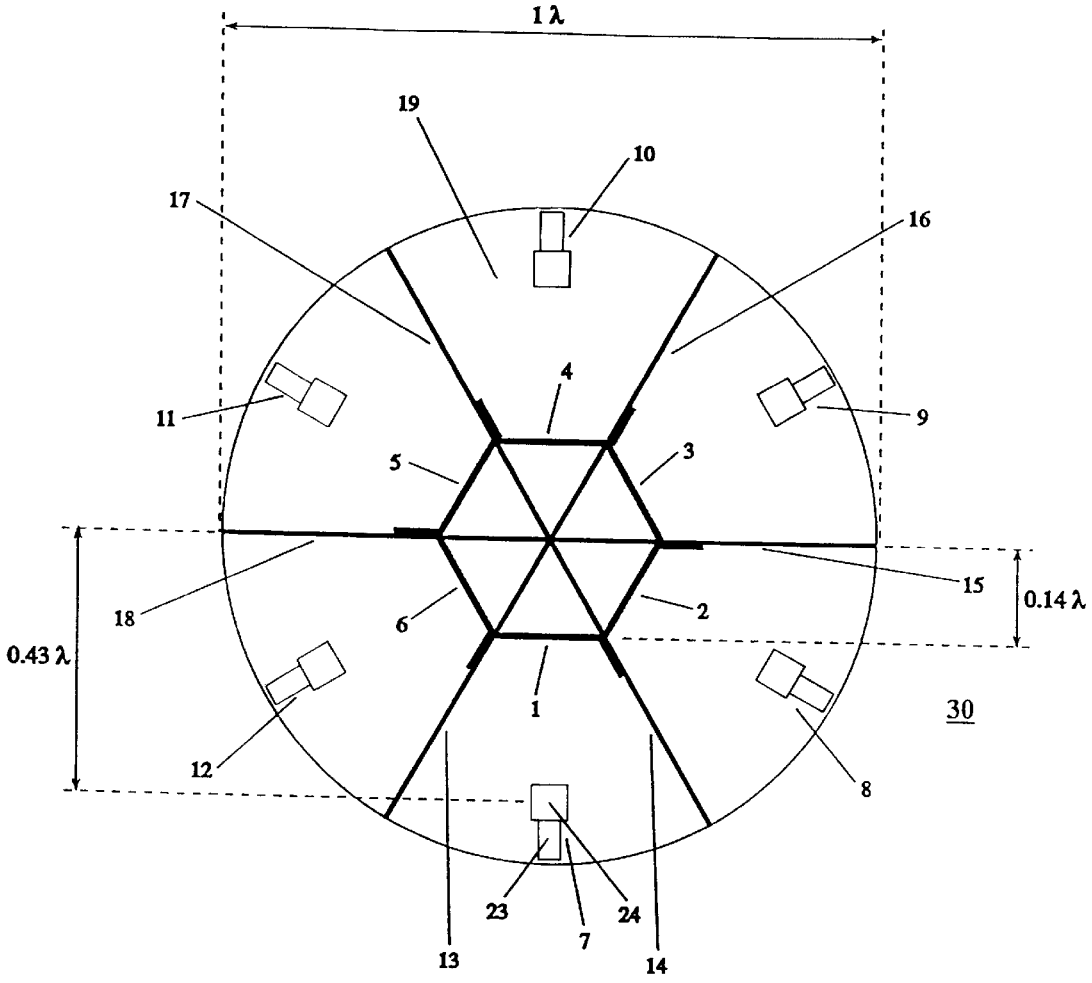
FIG. 2 is a top plan view of the invention showing all the twelve radiating elements.

Referring to FIGS. 1 & 2, a multiport beamforming antenna 30 is shown comprising twelve elemental antennas 1–12, mounted upon a round ground plane conductor 19 (here comprising copper). The multiport antenna 30 is designed for use at an operating frequency, as for example 1.7 GHz, where the multiport antenna 30 typically has lowest return loss. The term $\lambda$ as used herein means the wavelength at the operating frequency for which the multiport antenna is designed. Where the term "about" is used in relation to a dimension herein, it will be understood that minor deviations from the actual value given are acceptable providing the performance of the antenna is not compromised.

Six reflecting surfaces 13–18 (here comprising copper), each being of about equal length $\lambda/2$ along a ground plane, each having a shape of one quarter of a circle, are radially disposed about the center of the ground plane conductor 19, such as by soldering, to give a shape of hemisphere with six sixty degree sectors. The reflecting surfaces may have other shapes such as triangles, rectangles, or portions of other polygons. The reflecting surfaces 13–18 act as corner reflectors for the radiating elements 1–12 in corresponding sectors, and provide a shield for radiating elements in one sector from being substantially affected by the elements in other sectors. Each sector contains two radiating elements of different types. Elemental antennas 1–6 of the first type are responsive to radio frequency energy having a first polarization (here horizontal), while elemental antennas 7–12 of the second type are responsive to radio frequency energy having a second polarization (here vertical) orthogonal to the first polarization. With such an arrangement, both pattern diversity and polarization diversity are obtained. Accordingly, all the twelve radiating elements 1–12 are located in close proximity, within a radius of half wavelength at the operating frequency, to allow minimization of the antenna size, while substantial isolation between elemental antennas is still maintained. Further, a dual-polarization, multidirectional antenna system is provided having the ability to radiate or receive radio frequency energy with various planes of polarization in different directions.

Figure 3:
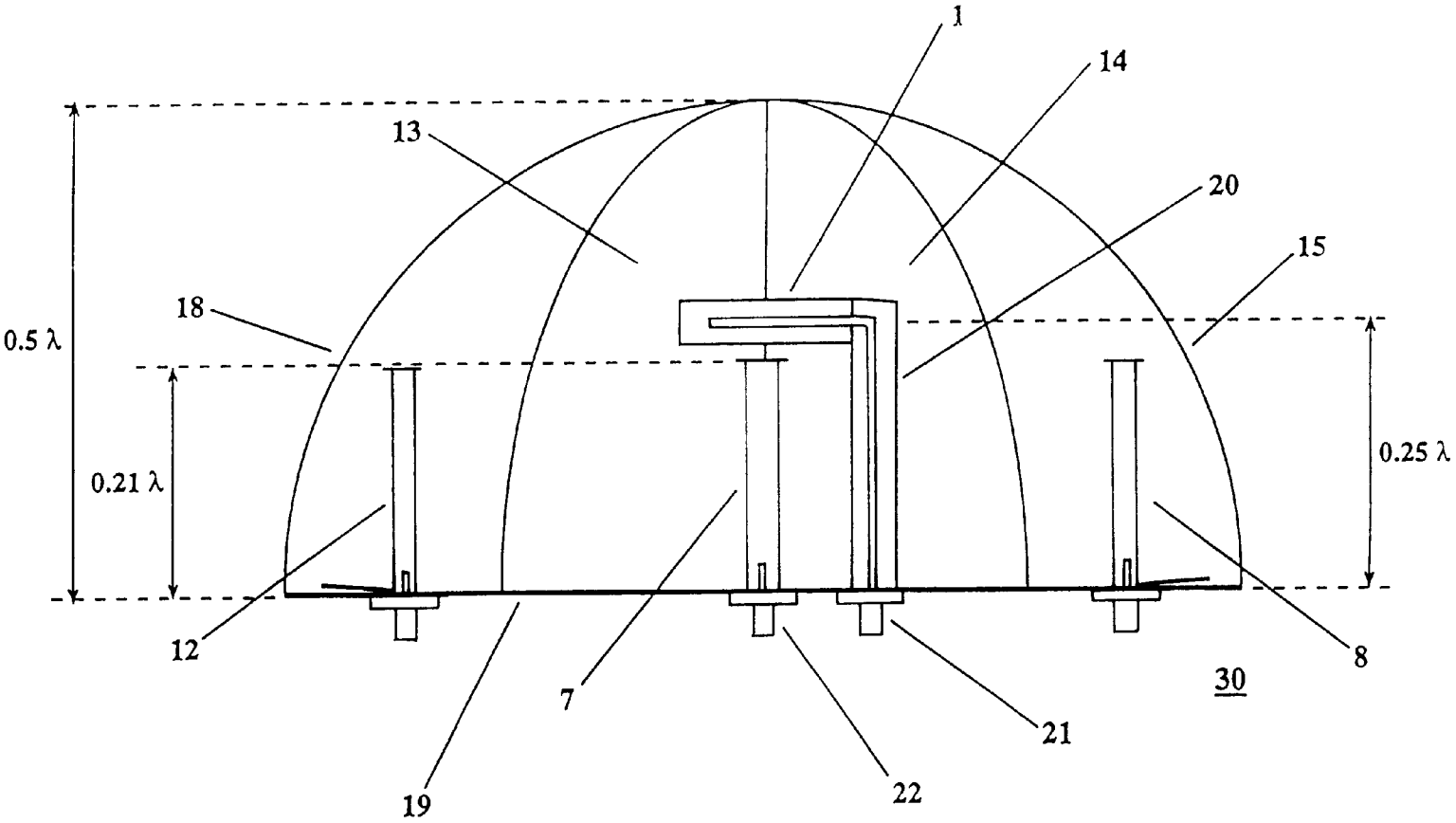
FIG. 3 is a side plan view of the invention showing two types of radiating elements in one sector.
Figure 4A:
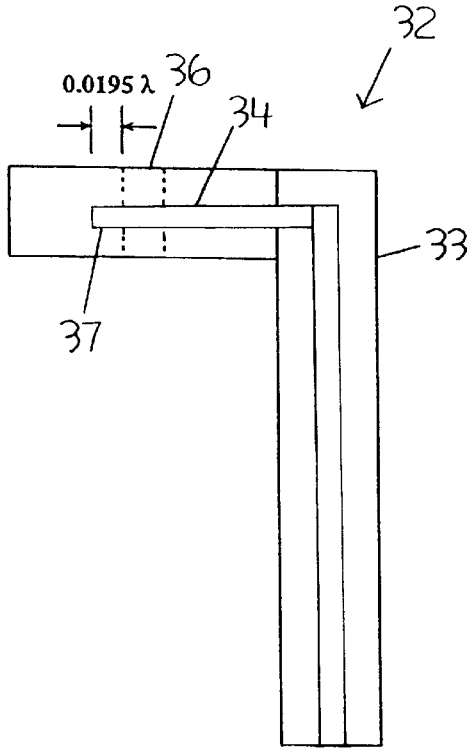
FIG. 4A is an outside view of the loop type elemental antenna.
Figure 4B:
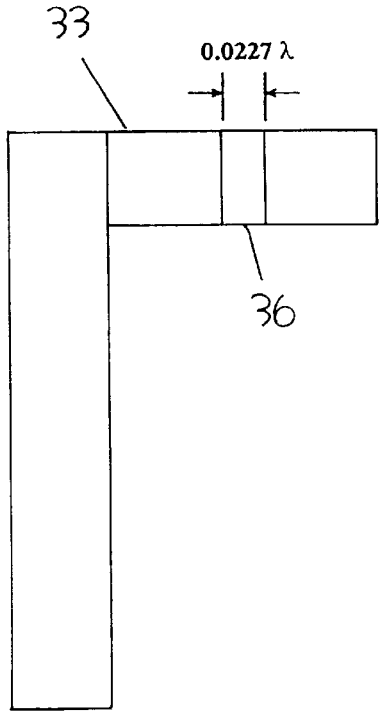
FIG. 4B is an inside view of the loop type elemental antenna.
Figure 4C:
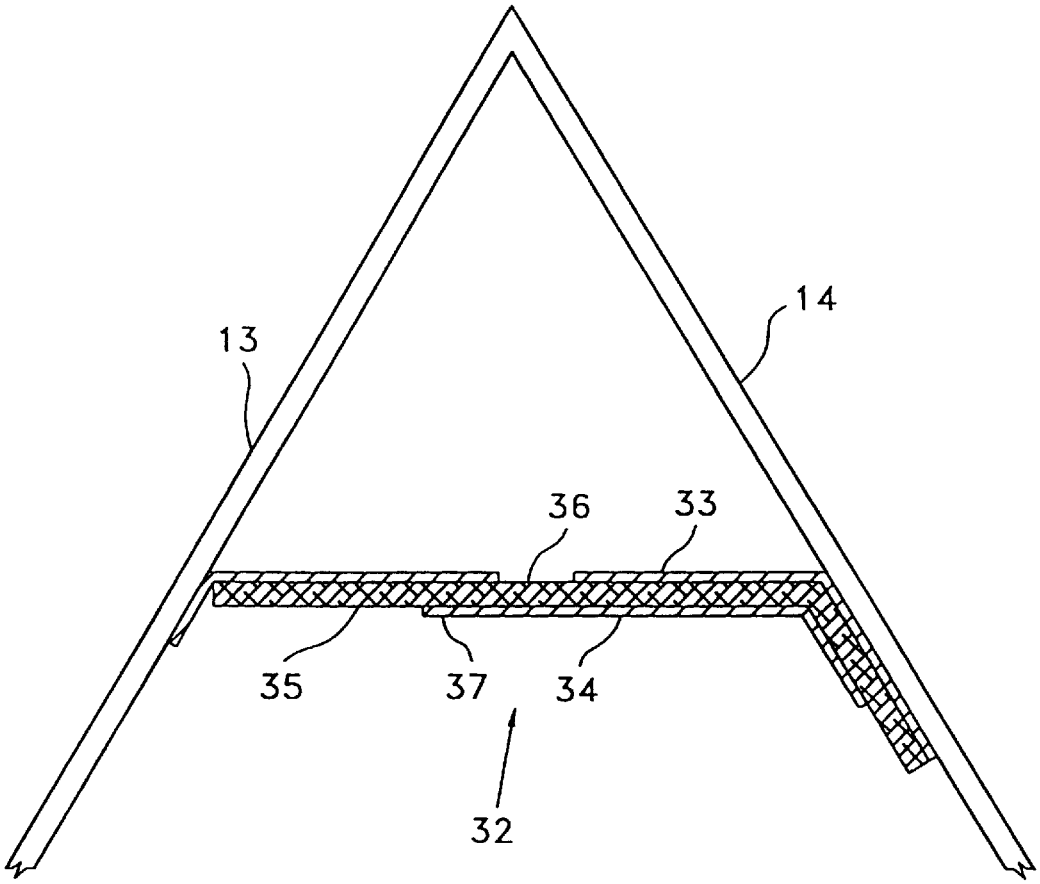
FIG. 4C is a top view of the loop type elemental antenna.

As depicted in FIG. 3, in the preferred embodiment, the first elemental antenna 1 in each sector comprises a horizontal center-fed loop type patch antenna mounted on the corner reflector. The loop antenna 1 is supported midway above the ground plane conductor 19 and coupled to a RF (radio frequency) feed 21 by a transmission line 20 soldered on one of the reflecting surfaces 14. To implement this configuration, an L-shaped microstrip line 32 (as shown in FIGS. 4A, 4B and 4C) is formed with a microstrip ground conductor 33 spaced from a microstrip conductor 34 by a dielectric 35. A gap 36 is provided on the ground plane side 33, for the purposes of providing a feed point and providing impedance matching. The microstrip conductor 34 overlaps the microstrip ground conductor 33 by overlap 37 beyond the gap 36. An elemental loop antenna formed of a microstrip line 32 is inversely mounted on the ground plane in each corner reflector. Consequently, all the RF feeds for the loop antennas 1–6 are located on the bottom side of the ground plane conductor 19 to make the installation of the entire antenna structure easier. With their horizontal orientation, loop antennas 1–6 are responsive to electromagnetic waves having horizontal polarization, and thereby are capable of producing a horizontally polarized beam of radio frequency energy having a predetermined radiation pattern individually. The electrically small loop antenna in this connection between the two shields has a low radiation resistance as well as a series inductance. This combination of components (with their normal values) can be matched to 50 ohms with a combination of the gap size adjustment (gap 36, FIG. 4B), which controls a shunt capacitive susceptance, and the overlap length adjustment (overlap 37, FIG. 4A), which controls a series capacitive reactance. Thus, the gap size and the overlap length are adjusted to provide approximately a 50 ohm input impedance with zero reactance at the desired frequency. The loop must be fed by a center gap to provide a polarization that is completely horizontal and not coupled to the monopole.

The second elemental antenna 7, as shown in FIG. 3, comprises a vertical monopole antenna (here comprising a flat strip of brass) disposed on top of the ground plane conductor 19, a distance from the loop antenna 1, and coupled to a RF feed 22 located on the bottom side of the ground plane 19. In the preferred embodiment, monopole antenna 7 further comprises an arbitrarily-shaped horizontal member 23 (as shown in FIG. 2) attached to the bottom end of the monopole 7, parallel to the ground plane conductor 19, for the purpose of impedance matching. An electrically short electric monopole (from input impedance considerations) may be treated as a series resistance, a large capacitive reactance and a small inductive reactance. The series resistance is smaller than 50 ohms and varies approximately as the square of the operating frequency. If one places a "capacitive hat" 24 on top of the antenna, one raises the resistance of the antenna (still less than 50 ohms) and decreases the series capacitive reactance of the antenna so that the inductive reactance will dominate. A capacitance can now be placed at the base of the antenna that will (as the well-known L match) raise the input resistance of the antenna and tune out the inductive reactance of the top loaded monopole. Monopole antennas 7–12 are responsive to electromagnetic waves having vertical polarization, and thus, capable of producing a vertically polarized beam of radio frequency energy having a predetermined radiation pattern individually. It has been found that, with the arrangement and configuration discussed above, the isolation between elemental antennas in each sector, namely the loop antenna and the monopole antenna, is very substantial. Therefore, element 1 & 7 are able to produce beams having orthogonal polarizations without coupling to each other.

Figure 5:
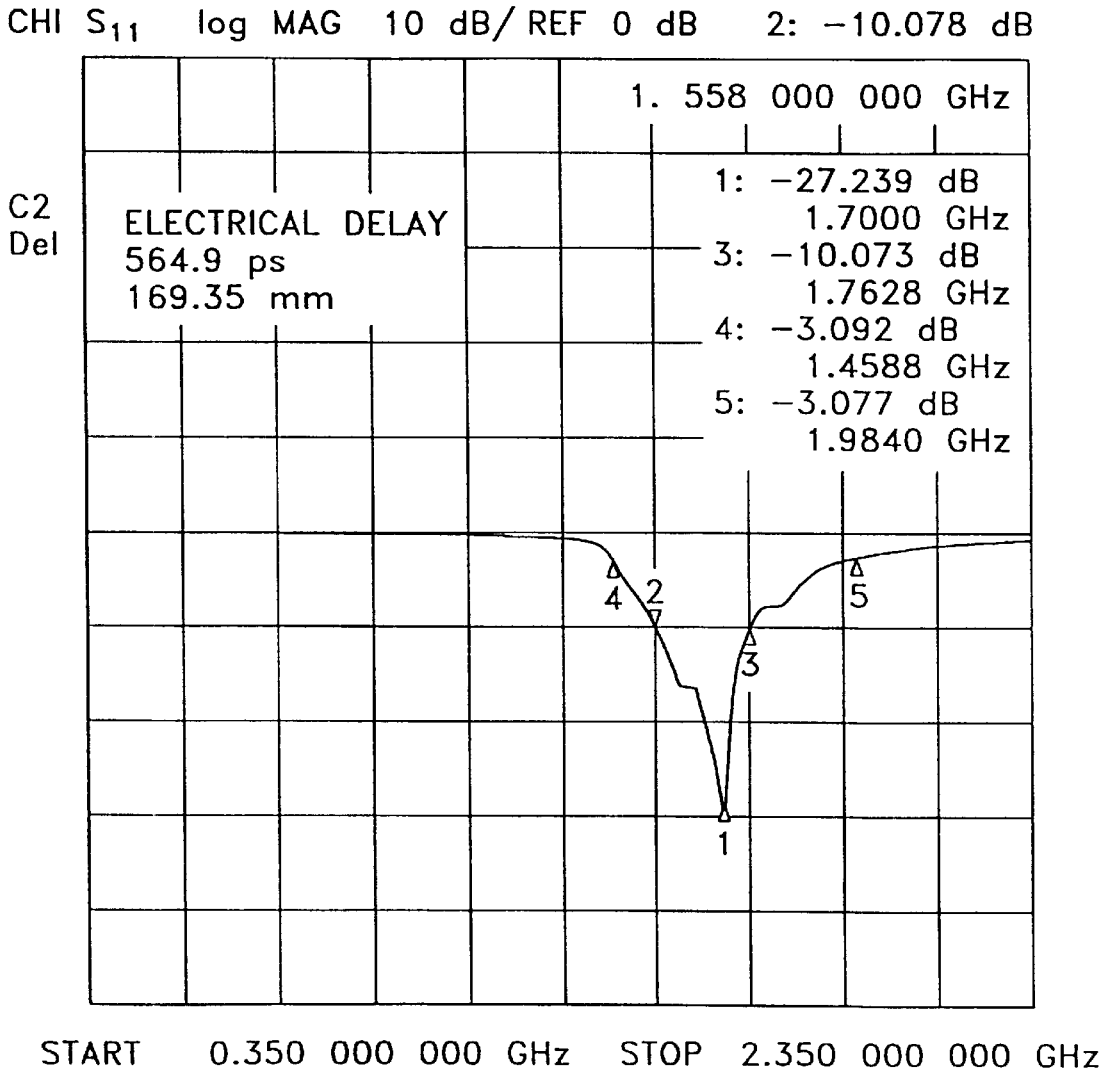
FIG. 5 is a graph illustrating the return loss of one of the loop type elemental antennas of the invention.

The return loss of one of the loop type elemental antennas is shown in FIG. 5. It is found that each loop type elemental antenna has a low return loss across the operating frequency band. In particular, the loop antenna has a return loss of less than 27 dB at the operating frequency of 1.7 GHz, with a 3 dB return loss bandwidth more than 29% of its operating frequency. Moreover, the 10 dB return loss bandwidth of the loop antenna is found to be more than 200 MHz, more than 12% of its bandwidth.

Figure 6:
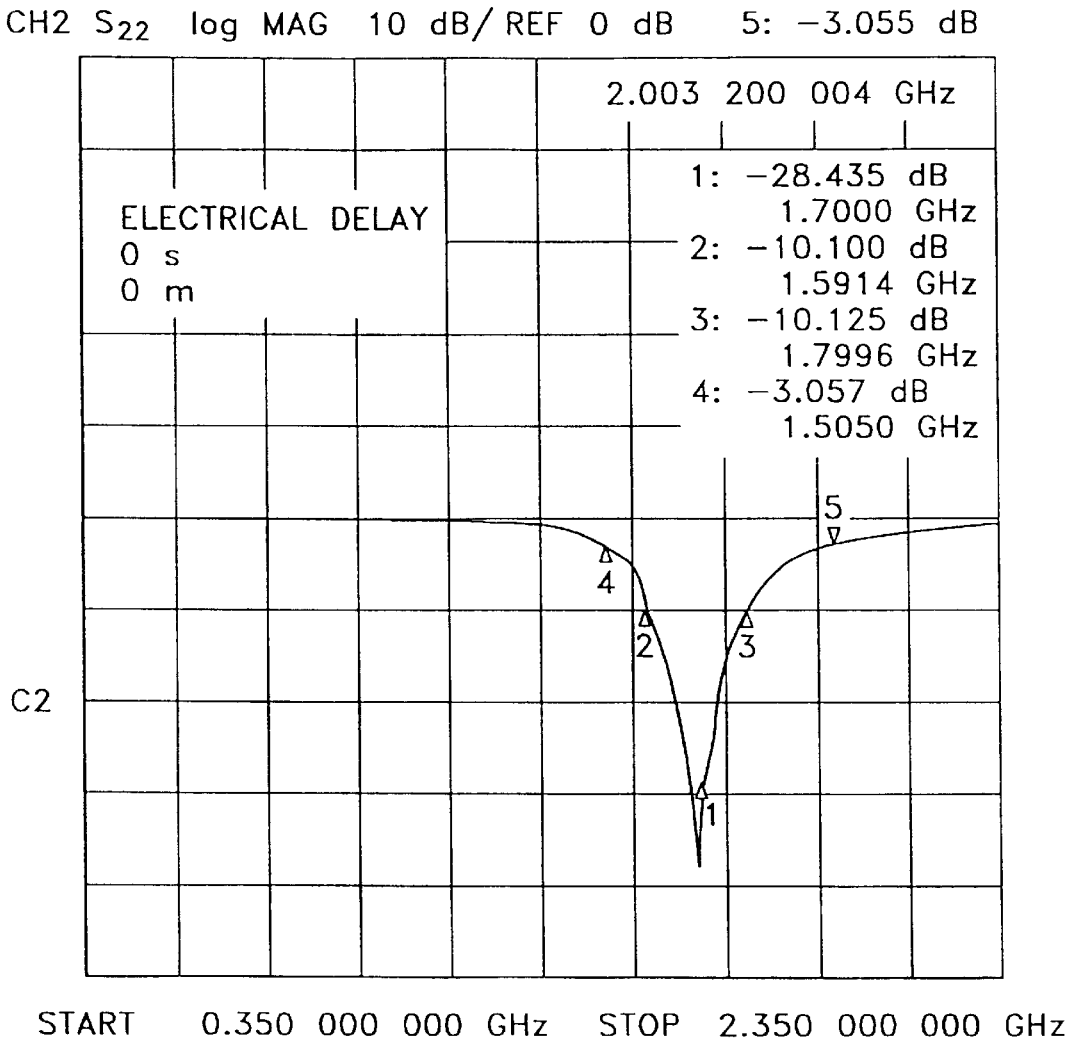
FIG. 6 is a graph illustrating the return loss of one of the monopole type elemental antennas of the invention.

The return loss of one of the monopole type elemental antennas is shown in FIG. 6. Each monopole antenna also has a low return loss across the operating band. As shown in FIG. 6, the return loss of the monopole antenna is better than 28 dB at 1.7 GHz, with a 3 dB return loss bandwidth more than 25% of its operating frequency, and the 10 dB return loss bandwidth is about 200 MHz, more than 12% of its bandwidth. Accordingly, the input impedance of each elemental antenna can be easily matched to RF circuits operating at the industrial standard of 50 ohms.

Figure 7:
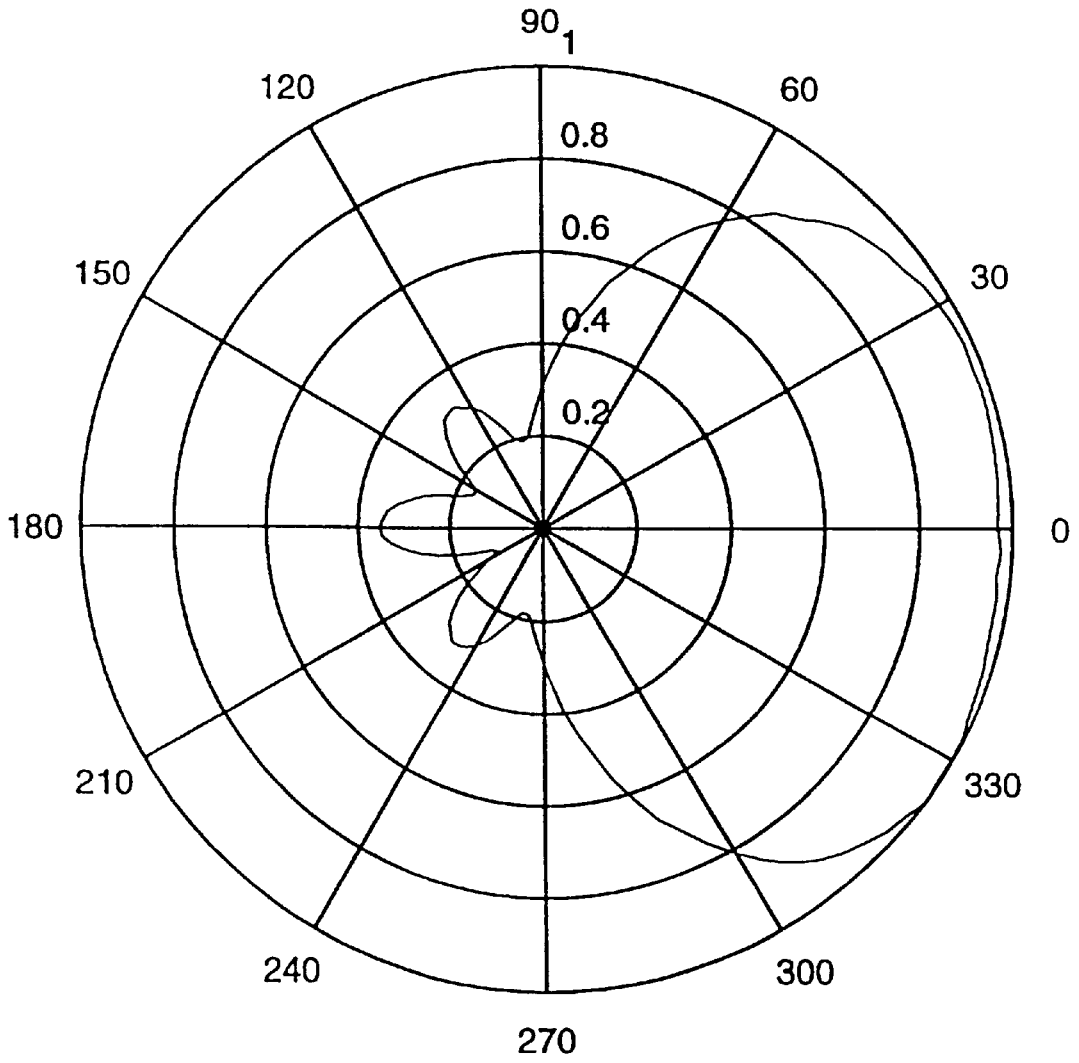
FIG. 7 is a graph illustrating the radiation pattern of one of the loop type elemental antennas.

The horizontal radiation pattern shown in FIG. 7 illustrates the individual beam pattern produced by the horizontally polarized loop antenna in each sector at the operating frequency of 1.7 GHz. The radiation pattern is found to be directional with horizontal beamwidth limited by the corner reflector. Besides, as shown in FIG. 7, the side lobes and the back lobe of the radiation pattern are found to be small.

Figure 8:
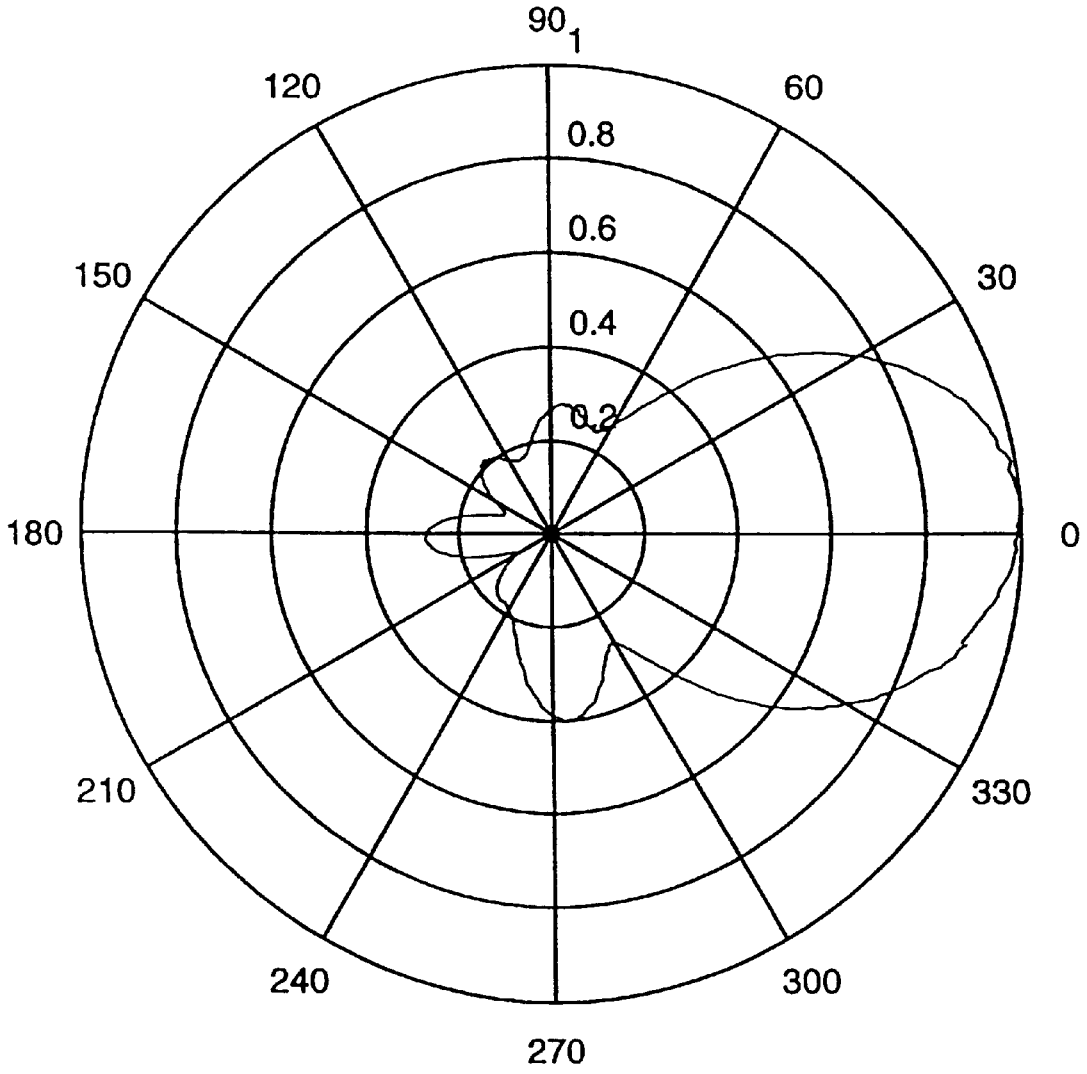
FIG. 8 is a graph illustrating the radiation pattern of one of the monopole type elemental antennas.

The horizontal radiation pattern shown in FIG. 8 illustrates the individual beam pattern produced by the vertically polarized monopole antenna in each sector at the operating frequency. The radiation pattern is found to be directional with a horizontal beamwidth narrower than that produced by the loop antenna. The side lobes and the back lobe of the radiation pattern are also small for the monopole antenna.

Figure 9:
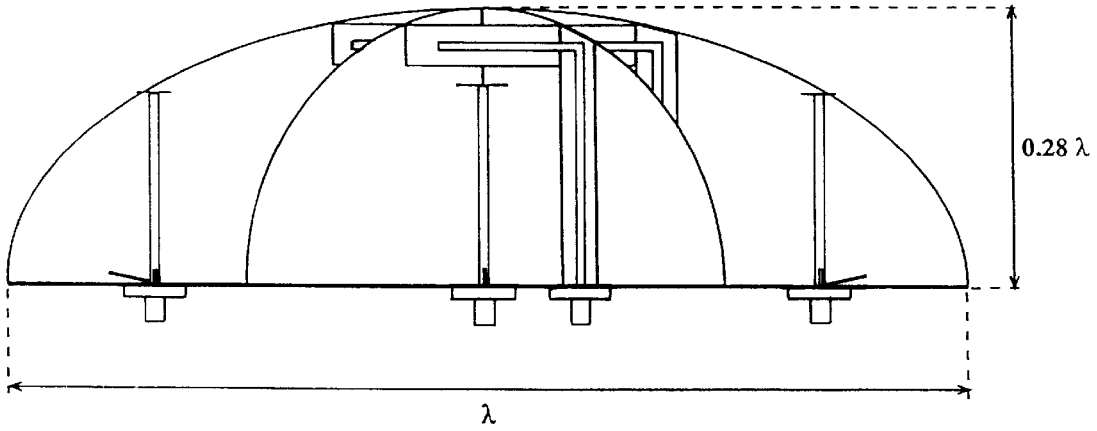
FIG. 9 is a side plan view of another preferred embodiment of the invention.

In some applications, it may be desirable to have a larger back lobe for both antennas, while still maintaining the isolation between the antennas. This can be achieved by simply lowering the height of each corner reflector, and thus, the height of the entire antenna structure. However, there is a tradeoff between the size of the back lobe produced and the elemental antenna isolations. FIG. 9 discloses another preferred embodiment of the present invention, a modified version of the multiport antenna 30, with a height of about half of the antenna structure 30 for the purpose of increasing the back lobe produced by each element.

The multiport antenna 30 may be integrated with a transmitter/receiver having digital signal processor to give a beam or space division multiple access system. With the utilization of an adaptive algorithm provided by the transmitter/receiver, the antenna is capable of handling multiple users on the same frequency channel at a time, and substantially cancel all the co-channel interference received. Furthermore, it is feasible for the antenna to receive multipath signals and combine them to allow recovery of the original multiple transmitted signals. In a low multipath environment, interfering signals are placed in nulls, while in a high multipath environment, the amplitude and phase of interfering signals are combined so that they are canceled.

Figure 10:
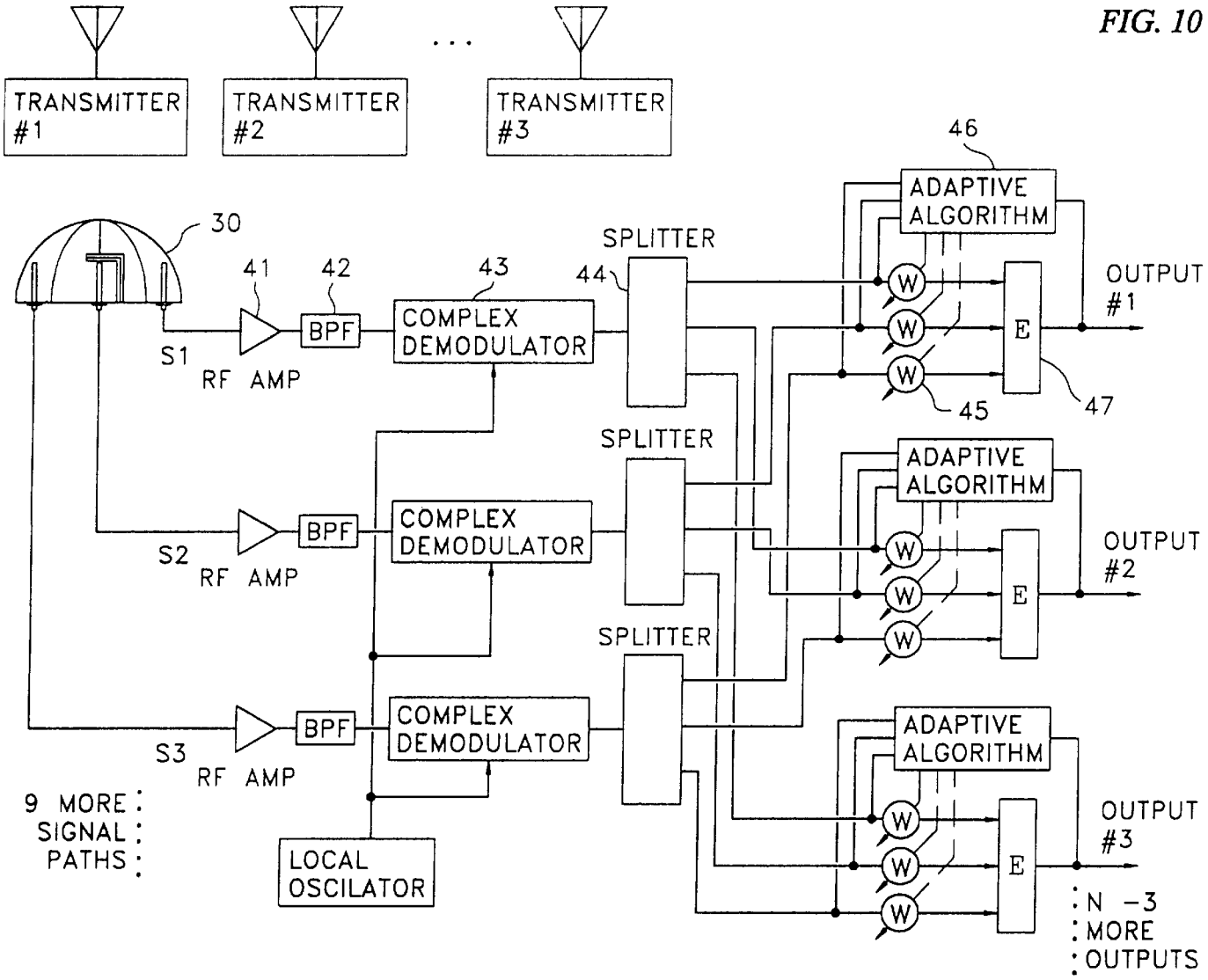
FIG. 10 is a schematic view of a receiving system for the antenna.

A proposed receiving system for the multiport antenna 30, as shown in FIG. 10, comprises twelve receiving modules connected to the corresponding elemental antennas and a digital signal processor with adaptive algorithm. Each receiving module consists of an amplifier, a bandpass filter, a complex (inphase and quadrature) demodulator and two analogto-digital converters. The RF signal received by each element is first amplified by an RF amplifier 41. The RF signal is routed into a bandpass filter 42 and down converted into orthogonal baseband signals in the I (in-phase) and Q (quadrature-phase) channels by demodulator 43. The complex I and Q signals are split into 4 to 8 separate outputs by splitter 44. Complex weights 45 are applied to each of these signals. The weights are set by one of a number of known mathematical methods such as the least mean squares method, the recursive least squares method or the direct matrix inversion method. These weights are set by the adaptive algorithm circuit block 46 which typically consists of a digital signal processor implementing one of the above or some other mathematical process for setting the tap weights. The twelve processed signals are summed in the summer 47 and each output signal should be a good approximation to the information signal from each corresponding transmitter.

Hence, there has been disclosed a novel multiport antenna with multiple elements providing multidirectional, uncorrelated beams. By intelligently applying two elemental antennas in the same sector, radiating elements are located in close proximity allowing reduction in antenna size, while substantial isolation between all elements is still sustained. The multiport antenna exhibits a good isolation between elements and a practical input impedance for each elemental antenna over a wide bandwidth. The dimensions of elemental antennas and their locations relative to the ground plane conductor are selected to provide maximum isolation between elements and optimal input impedance for each element at the operating frequency. The arrangement and configuration of the elemental antennas may be altered to operate in other frequency bands and to have wider or narrower bandwidths. For example, if either or both of the monopole elemental antenna or the loop antenna is moved closer to the corner of the corner cube reflector, then the bandwidth of the multiport antenna is reduced. While the disclosed embodiment has been made for use at the 1.7 GHz PCS band, its dimensions may be modified for use at a wide range of frequencies. The upper range of frequencies (eg in the order of 10–100 GHz) is limited by maintaining required tolerances for small devices, while the lower range is limited by practical limitations on the size of the devices, as for example use at AM frequencies would require a 150 m high antenna.

Immaterial modifications may be made to the disclosed embodiments of the invention without departing from the essence of the invention.

We claim:

1. A multiport antenna having an operating frequency with wavelength $\lambda$, the multiport antenna comprising:

multiple corner reflectors, each corner reflector being mounted to produce a radiation pattern that extends outward from the multiport antenna;

plural first elemental antennas, a first elemental antenna being disposed in each corner reflector, each first elemental antenna being oriented to produce a first radiation pattern having a first polarization; and plural second elemental antennas, a second elemental antenna being disposed in each corner reflector, each second elemental antenna being oriented to produce a second radiation pattern having a second polarization that is different from the first polarization.

2. The multiport antenna of claim 1 in which the first polarization is orthogonal to the second polarization.

3. The multiport antenna of claim 2 in which each corner reflector is formed from a pair of intersecting reflecting surfaces that intersect along a line of intersection, and the lines of intersection of the corner reflectors are coaxially mounted at a common central axis.

4. The multiport antenna of claim 3 in which the corner reflectors are mounted on a common ground plane.

5. The multiport antenna of claim 4 in which the intersecting reflecting surfaces forming the corner reflectors decrease in height with distance outward from the central axis.

6. The multiport antenna of claim 5 in which the intersecting reflecting surfaces have curved outer edges.

7. The multiport antenna of claim 5 in which the intersecting reflecting surfaces have shapes selected from a group consisting of quarter circles, quarter ellipses and portions of polygons.

8. The multiport antenna of claim 4 in which, in each corner reflector, the first elemental antenna is a monopole.

9. The multiport first elemental antenna of claim 8 in which the antenna is a shortened monopole with multiple loadings selected from the group consisting of capacitive and inductive loadings.

10. The multiport antenna of claim 8 in which, for each corner reflector, the first elemental antenna is mounted parallel to the common central axis.

11. The multiport antenna of claim 10 in which, for each corner reflector, the second elemental antenna is a loop antenna mounted parallel to the common ground plane.

12. The multiport antenna of claim 11 in which the loop antenna incorporates a gap in a ground conductor whose size is selected for impedance matching.

13. The multiport antenna of claim 12 in which the loop antenna includes a microstrip conductor spaced from the ground conductor, and the microstrip conductor overlaps the gap in the ground conductor by an amount selected to provide impedance matching with zero reactance at the operating frequency.

14. The multiport antenna of claim 4 in which, for each corner reflector, the first elemental antenna is a monopole and the second elemental antenna is a loop antenna.

15. The multiport antenna of claim 14 in which, for each corner reflector, the second elemental antenna is mounted closer to the common central axis than the first elemental antenna.

16. The multiport antenna of claim 14 in which, for each corner reflector, the second elemental antenna is center fed.

17. The multiport antenna of claim 4 in which the multi-port antenna in the ground plane has a diameter about equal to $\lambda$.

18. The multiport antenna of claim 17 in which the corner reflectors have a height about equal to $\lambda/4$.

19. The multiport antenna of claim 1 in which there are at least three and not more than eight of the corner reflectors.

20. The multiport antenna of claim 1 in which there are six of the corner reflectors.

21. The multiport antenna of claim 1 in which:

each corner reflector is formed from a pair of intersecting reflecting surfaces that intersect along a line of intersection, and the lines of intersection of the corner reflectors are coaxially mounted at a common central axis;

there are at least six of the corner reflectors mounted on a common ground plane;

the intersecting reflecting surfaces forming the corner reflectors decrease in height with distance outward from the common central axis; and in each corner reflector, the first elemental antenna is a monopole mounted parallel to the common central axis and the second elemental antenna is a center fed loop antenna mounted parallel to the common ground plane, the second elemental antenna being located closer to the common central axis than the first elemental antenna.

22. The multiport antenna of claim 1 in which:

the corner reflectors are formed from a pair of intersecting reflecting surfaces of about equal length mounted on a ground plane; and the length of the corner reflectors at the ground plane is about equal to $\lambda/2$.

23. The multiport antenna of claim 22 in which the second elemental antenna has a height about equal to $\lambda/4$.

24. The multiport antenna of claim 1 in which the 3 dB return loss bandwidth of the second elemental antenna is more than 29% of its operating frequency.

25. The multiport antenna of claim 1 in which the 3 dB return loss bandwidth of the first elemental antenna is more than 25% of its operating frequency.

26. The multiport antenna of claim 1 in the 10 dB return loss bandwidth of the second elemental antenna is more than 12% of its operating frequency.

27. The multiport antenna of claim 1 in the 10 dB return loss bandwidth of the first elemental antenna is more than 12% of its operating frequency.

* * * * *